US007412772B1

(12) United States Patent
Khoshnood

(10) Patent No.: US 7,412,772 B1
(45) Date of Patent: Aug. 19, 2008

(54) ARCHERY BOW SIGHT

(76) Inventor: Bahram Khoshnood, 1324 Union Hill Rd., Suite B, Alpharetta, GA (US) 30004

( * ) Notice: Subject to any disclaimer, the term of this patent is extended or adjusted under 35 U.S.C. 154(b) by 56 days.

(21) Appl. No.: 11/644,515

(22) Filed: Dec. 22, 2006

Related U.S. Application Data

(60) Provisional application No. 60/753,736, filed on Dec. 27, 2005.

(51) Int. Cl.
*F41G 1/467* (2006.01)

(52) U.S. Cl. ..... 33/265; 124/87

(58) Field of Classification Search ..... 33/265; 124/87
See application file for complete search history.

(56) References Cited

U.S. PATENT DOCUMENTS

| | | | | |
|---|---|---|---|---|
| 4,377,152 | A * | 3/1983 | Saunders | 124/87 |
| 4,823,474 | A | 4/1989 | Reynolds | |
| 4,979,309 | A | 12/1990 | Oligschlaeger | |
| 5,001,837 | A | 3/1991 | Bray | |
| 5,152,068 | A * | 10/1992 | Meister et al. | 33/265 |
| 5,359,780 | A | 11/1994 | Dallaire | |
| 5,384,966 | A * | 1/1995 | Gibbs | 33/265 |
| 5,425,177 | A | 6/1995 | Pacenti | |
| 5,435,068 | A * | 7/1995 | Thames et al. | 33/265 |
| 5,524,351 | A | 6/1996 | Pinson et al. | |
| 5,651,185 | A | 7/1997 | Vanderheyden et al. | |
| 5,920,996 | A | 7/1999 | Hurckman et al. | |
| 6,061,919 | A * | 5/2000 | Reichert | 33/265 |
| 6,079,111 | A | 6/2000 | Williams et al. | |
| 6,493,951 | B1 | 12/2002 | Smith et al. | |
| 6,796,039 | B2 | 9/2004 | Walbrink | |
| 6,868,614 | B2 | 3/2005 | Floied et al. | |
| 6,922,900 | B1 * | 8/2005 | Henry | 33/265 |
| 2002/0073560 | A1 * | 6/2002 | LoRocco | 33/265 |

* cited by examiner

*Primary Examiner*—G. Bradley Bennett
(74) *Attorney, Agent, or Firm*—Rodgers & Rodgers

(57) ABSTRACT

A bow sight having a support member with a sight unit disposed at one end a sight pin disposed within the sight unit, a guide member integrally joined to the sight unit and being detachably joined to the support member, a fixed adjustment bar extending from the guide member, and a flexible cable interconnected to the sight pin at one end and fixed to the adjustment bar at the other end.

5 Claims, 2 Drawing Sheets

ARCHERY BOW SIGHT

The benefits of 35 U.S.C. 119 are claimed of provisional patent application 60/753,736 filed Dec. 27, 2005.

BACKGROUND OF THE INVENTION

This invention relates to an improvement in a bow sighting device. Depending on the weight and aerodynamic characteristics of the arrow, a bow sight allows the archer to increase the probability of accurately striking the desired target. Of course, the weight of the arrow requires that the archer aim higher vertically as the distance to the target increases.

It is desirable to provide a bow sight which allows the archer to adjust the sight pin either up or down while in the act of shooting an arrow. The archer draws the string with an arrow attached and the sight pin on the target. Then, by the archer extending the index finger of the bow hand, it comes into contact with adjustment knob attached to the bow sight by means of a flexible shaft and then rotating the knob so as to move the sight pin either up or down to accommodate for either a closer or longer shot. In known systems, it is not easy to maintain an accurate adjustment, especially in tense hunting situations where the sight pin can easily be moved from its desired position when the adjusted rod is bumped.

BRIEF SUMMARY OF THE INVENTION

According to this invention, a bow sight is provided and comprises a support member having front and rear ends, a sight unit secured to the front end, a sight pin disposed within the sight unit, a guide member integrally joined to the sight unit and being detachably joined to the support member at the front end, a rigid adjustment bar extending from the guide member with a turning knob disposed at the opposite end, and a flexible cable interconnected at one end to the sight pin and being affixed at the other end to the turning knob whereby operation of the turning knob moves the sight pin vertically.

DETAILED DESCRIPTION OF THE INVENTION

Figure 1:
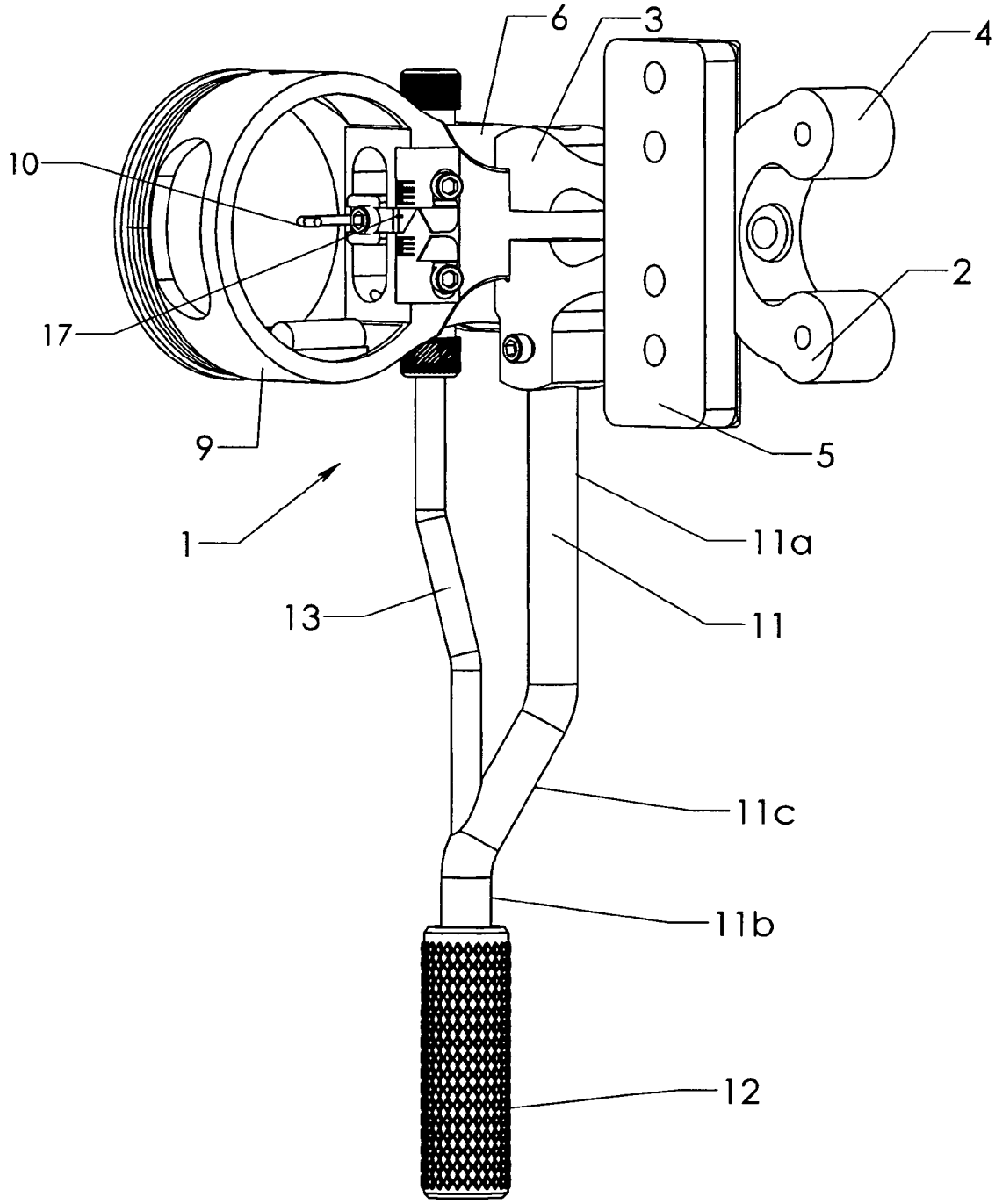
FIG. 1 is a perspective view of a bow sight according to this invention.

With attention to the drawings and with particular reference to FIG. 1, the bow sight, according to this invention, is generally indicated by the numeral 1. Bow sight 1 includes support member 2 having front end 3 and rear end 4. Mounting plate 5 is disposed intermediate front end 3 and rear end 4 and is secured to support member 2. Guide member 6 includes protrusion 7 formed on one side which is slideable in slot 8 for purposes of attachment to support member 2. Sight unit 9 is internally joined to guide member 6 and sight pin 10 extends inwardly of sight unit 9, as is well known.

Figure 2:
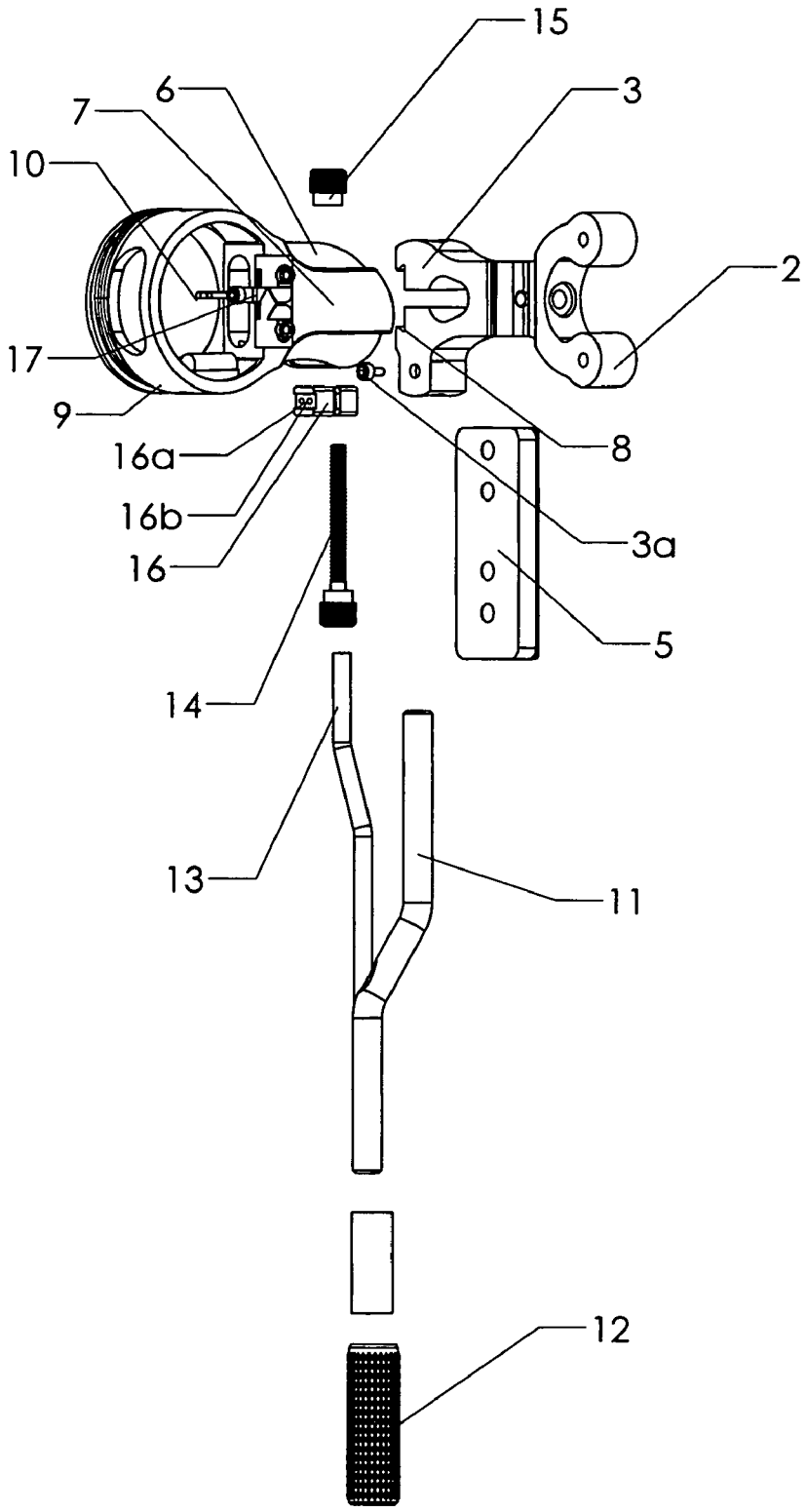
FIG. 2 is an exploded view of the bow sight.

As best viewed in FIG. 2, rigid adjustment bar 11 extends into an opening in support member 2 and is fixed in position by means of set screw 3*a*. Turning knob 12 is formed on the free end of adjustment bar 11. Adjustment bar 11 comprises two offset portions 11*a* and 11*b* which are interconnected by connecting piece 11*c*.

According to this invention, flexible cable 13, at its lower end, extends through an opening in offset portion 11*b* and is fixed to turning knob 12. The opposite end of flexible cable 13 is fixed to the head of lead screw 14 with the opposite end of lead screw 14 screwed into nut 15 such that lead screw 14 is freely rotatable within guide member 6. Nut 16 is disposed within guide member 6 and is threaded onto lead screw 14. Sight pin 10 is secured at one end to aperture 16*a* formed in nut 16. Finally, marker 17 is secured to the other aperture 16*b* formed in nut 16.

In operation, initially the archer loosens set screw 3*a* and rotates adjustment bar 11 to the optimum position depending on the desires and physical requirements of the archer. Then set screw 3*a* is tightened to fix adjustment bar 11 in place. Since cable 13 is flexible, it easily follows the movement of adjustment bar 1. Then, in order to set sight pin 10 in position, the archer uses the index finger to rotate turning knob 12 which in turn causes flexible cable 13 to turn since it is fixed to turning knob 12. Since flexible cable 13 is fixed to lead screw 14, as lead screw 14 rotates, nut 16 is caused to move up or down vertically because it is threaded to lead screw 14. Therefore, sight pin 10 is secured to nut 16 and, by this invention, is easily and precisely moved vertically for purposes of aiming the arrow. Also, since marker 17 is fixed to nut 16, it moves vertically in conjunction with sight pin 10. When the proper position for sight pin 10 is attained, a strip of Mylar or other suitable means is used to mark the point indicated by marker 17 so that the archer can return sight pin 10 to the marked position as desired. Therefore, by this invention, an archery bow sight is provided which allows the adjustment bar to be rotated to the optimum position as desired by the archer and also allows for convenient and precise positioning of sight pin 10.

The invention claimed is:

1. A bow sight comprising a support member, said support member having spaced front and rear ends, a sight unit secured to said front end, a guide member integrally joined to said sight unit, said guide member detachably joined to said support member, an adjustment bar adjustably rotatable within said guide member at one end thereof, a turning knob affixed to said adjustment bar at the other end thereof, a flexible cable affixed to said turning knob at one end thereof, and a sight pin disposed within said sight unit and being interconnected to on the other end of said flexible cable.

2. A bow sight according to claim 1 wherein said adjustment bar comprises a pair of offset portions interconnected by means of a connecting portion.

3. A bow sight according to claim 1 wherein a lead screw is affixed to said other end of said flexible cable, a nut is threadably interconnected to said lead screw, and said sight pin is connected to said nut.

4. A bow sight according to claim 3 wherein said sight pin at one end is disposed in an aperture formed in said nut and a marker is disposed in another aperture formed in said nut.

5. A bow sight according to claim 4 wherein said adjustment bar is secured within said guide member by means of a set screw.

* * * * *